US008281441B1

(12) United States Patent
Erlich et al.

(10) Patent No.: US 8,281,441 B1
(45) Date of Patent: Oct. 9, 2012

(54) HAND-HELD SUBMERSIBLE POOL AND SPA POWER CLEANER

(75) Inventors: Guy Erlich, Monroe Township, NJ (US); James Kosmyna, Old Bridge, NJ (US)

(73) Assignee: Water Tech LLC, East Brunswick, NJ (US)

( * ) Notice: Subject to any disclaimer, the term of this patent is extended or adjusted under 35 U.S.C. 154(b) by 35 days.

(21) Appl. No.: 13/068,644

(22) Filed: May 16, 2011

(51) Int. Cl.
*E04H 4/16* (2006.01)

(52) U.S. Cl. ..... 15/1.7

(58) Field of Classification Search ..... 15/1.7; 210/416.2, 167.1
See application file for complete search history.

(56) References Cited

U.S. PATENT DOCUMENTS

2005/0247613 A1* 11/2005 Bishop et al. ..... 210/169
* cited by examiner

*Primary Examiner* — Shay Karls
(74) *Attorney, Agent, or Firm* — Abelman, Frayne & Schwab

(57) ABSTRACT

A hand-held submersible power cleaner for cleaning debris from a swimming pool includes a housing having an inlet at a front end thereof which communicates with an interior cavity of the housing. An intermediate conduit having front and rear ends extends through the interior cavity. A filter is positioned between the inlet and front end of the intermediate conduit. A removable drive assembly having an impeller at a forward end and a power switch at the opposing end is removably inserted into the housing such that the impeller faces the rear end of the intermediate conduit. Dual outlet conduits communicate with the rear end of the intermediate conduit, wherein the impeller draws water and debris through the inlet, the filter occludes the debris and retains it in the cavity while the water flows through the filter assembly into the intermediate conduit, and is discharged through the dual outlet conduits at the rear of the housing.

17 Claims, 5 Drawing Sheets

HAND-HELD SUBMERSIBLE POOL AND SPA POWER CLEANER

CROSS-REFERENCE TO RELATED APPLICATION

This patent application contains subject matter related to commonly assigned U.S. design application Ser. No. 29/373,739, filed contemporaneously herewith, and the content of which is incorporated by reference herein in its entirety.

FIELD OF INVENTION

The present invention is related to submersible pool cleaners, and more specifically to a hand-held submersible power cleaner for a spa or pool such as a children's kiddie-pool.

BACKGROUND OF THE INVENTION

Plastic wading pools or kiddie-pools for children are widely used during the summer months as a relief from the heat and for enjoyment of water activities. These pools can be constructed from a plastic film that is supported upon a framework, or by rigid molded plastic, either of which can be set up in a yard or other recreational area. The pools are usually circular or oval in shape having a general diameter of approximately 3-10 feet and a height of approximately 12-20 inches. The kiddie-pool is ideally used for outdoor recreation and is typically filled with water by a garden hose.

Although the kiddie-pools are primarily used by children of all ages including toddlers through pre-teen children, adults also enjoy soaking their feet in the pools while watching their children or otherwise relaxing. As the foot traffic into and out of the pool can be quite high with children running around and parents or guardians chasing after them, dirt and debris is often carried into the pool from the bottoms of the feet of the children and/or adults. Often the homeowner may find it necessary to spill the water out and replace it with fresh, clean water. As the water in the pool is heavy, frequently spilling out the dirty water can be an undesirable labor intensive task. Further, the discarded water can flood and damage surrounding grass and gardens, as well as make the recreational area slippery and dangerous for children and adults alike.

Similarly, many homeowners have spas and/or small ponds installed outdoors for their recreational enjoyment. These outdoor water-filled containers are also subject to collecting debris from the surrounding environment from users' feet and require frequent maintenance and cleaning.

There are various types of water skimming filter devices that can be used to skim the water surface or bottom of the pool, spa or small pond to remove undesirable debris; however, these water skimming devices are often bulky to use in a small children's swimming pool. Further, the water skimmers must be cleaned off after removing captured debris so as not to reintroduce the captured debris back into the pool, spa or pond after use.

Therefore, there is a need for a hand-held submersible power cleaner for a spa, small pond or children's size pool that is inexpensive and efficient in capturing and removing undesirable debris from the bottom and other submerged horizontal surfaces.

SUMMARY OF THE INVENTION

The disadvantages heretofore associated with the prior art are overcome by the present invention of a hand-held submersible power cleaner which can be advantageously used in various water containers, such as a children's kiddie-pool, a spa and/or a small outdoor pond. The hand-held submersible power cleaner of the present invention advantageously enables a home owner or other user to quickly remove debris from a pool, spa and/or pond, i.e., a "water-filled container", without the hassle of external power lines, heavy lifting or providing a large storage space. Rather, the cleaner of the present invention is versatile in use with respect to being suitable for cleaning small pools, spas and/or small ponds. The hand-held cleaner is light in weight and ergonomic in shape to enable a user to easily maneuver the cleaner along a submersed planar surface, as well as adjacent sidewalls, corners and crevices to clean most, if not all, areas of the water-filled container.

In one embodiment, the power cleaner of the present invention includes an elongated housing having an inlet positioned at a front end thereof and communicating with an interior cavity formed within the housing; an intermediate conduit having a front end and an opposing rear end, the front end extending longitudinally through a portion of said interior cavity. A filter assembly is positioned within the cavity between the inlet and front end of the intermediate conduit. A removable drive assembly having a motor-driven impeller is attached at a forward end and a power switch is provided at an opposing end on the exterior of the cleaner where it can be easily accessed for manual operation while holding the cleaner in or out of the water. The forward end of the drive assembly can be removably inserted into a channel such that the impeller faces the rear end of the intermediate conduit. At least one outlet conduit is provided in communication with the rear end of the intermediate conduit, wherein activation of the impeller draws pool water and debris through the inlet, and the filter assembly filters the debris and retains it in the cavity while the cleansed water flows through the filter assembly, the intermediate conduit, and is discharged through the at least one outlet conduit.

In one aspect, the hand-held submersible power cleaner includes a removable handle extending from a first channel formed in the rear end of the housing. The handle can be a telescoping handle or formed from tubular segments that can be snap-fit together to form a pole of any desired length for extended reach during the cleaning process.

In one embodiment, the housing comprises two parts, including an elongated body and a housing cover. The housing cover is preferably removably attached to a front portion of the elongated body and includes the inlet opening or nozzle. In yet another aspect of the cleaner, the interior of the housing and a portion of the interior of the body form the cavity.

In one embodiment, the filter assembly includes a frame having a mesh filter material disposed thereon. In another embodiment, the cleaner includes a second channel formed in the rear portion of the housing and is configured to receive the front portion of the drive assembly. The second channel and front portion of the drive assembly can be keyed to assure proper alignment and provide additional frictional forces to retain the drive assembly in the desired position in the second channel.

In one aspect, the drive assembly comprises a motor having a shaft for rotating the impeller, and at least one battery for providing power to the motor. The drive assembly defines a water-tight battery compartment for receiving, e.g., three batteries. Preferably, the drive assembly includes a power switch for selectively activating the motor at its exterior end portion which projects from the housing for easy access by the user.

In one embodiment, at least one outlet or discharge conduit extends longitudinally along the rear end of the housing. Preferably, the at least one outlet conduit comprises a pair of outlet conduits, each outlet conduit being positioned on an opposing lateral side of the drive assembly.

In yet another aspect, the hand-held submersible power cleaner includes a pair of rollers rotatably attached to the front end of the housing and which function to support the inlet or nozzle opening in close proximity to the surface being cleaned and to facilitate its easy movement at a predetermined distance from the surface. In another embodiment, a resilient flap is disposed over the inlet and biased to the closed position. The flap flexes into the cavity to permit the flow of water and debris when the unit is operating, while preventing the escape of debris from the cavity when water is not flowing.

In an embodiment, the impeller includes a plurality of blades that produce a flow of water which is displaced from the blades at an angle approximately sixty degrees from the central axis along the impeller shaft. In one aspect, the impeller includes a plurality of blades having a pitch in the range of approximately 40 to 120 millimeters.

BRIEF DESCRIPTION OF THE DRAWINGS

Further advantages and features of the present invention will become apparent from the detailed description of a preferred embodiment of the invention in reference to the accompanying drawings, in which.

Figure 1:
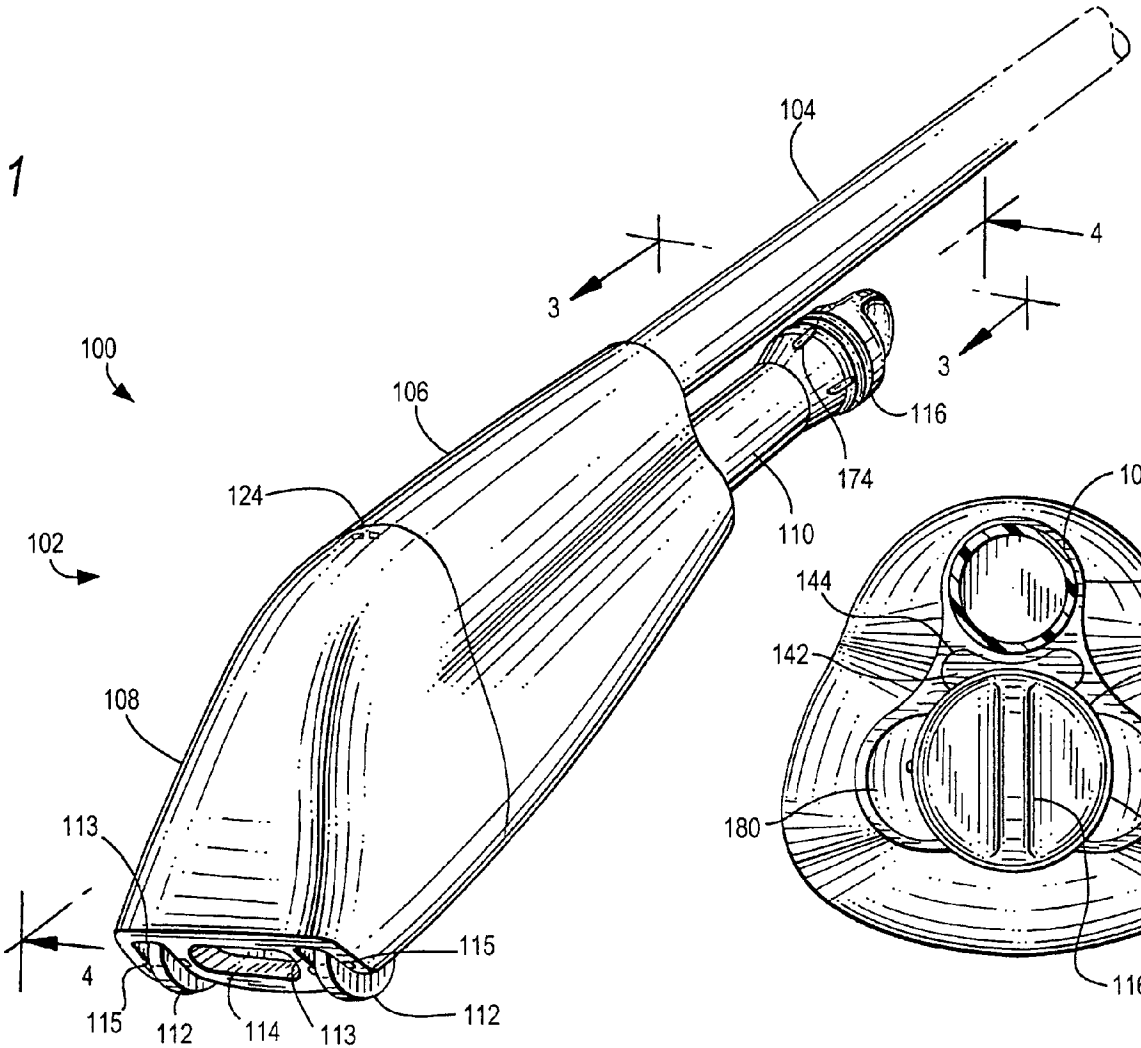
FIG. 1 depicts a front, right side perspective view of a hand-held submersible power cleaner of the present invention.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Referring to FIG. 1, a perspective view of a hand-held submersible power cleaner 100 of the present invention is illustratively shown. The pool cleaner 100 comprises a housing 102 and an optional elongated handle 104 extending from a back portion of the housing 102. More specifically, the housing 102 includes a body portion 106 for removably receiving a drive assembly 110 and the handle 104, as well as housing a filter assembly 118, and retaining the debris removed from the pool. The housing 102, handle 104, and drive assembly 110 are fabricated from a material that resists degradation by chemicals that might be placed in pools and spas, and the UV rays of the sun. Suitable materials include acrylonitrile butadiene styrene (ABS) plastic, polypropylene, polyvinyl chloride (PVC), among other well-known lightweight, durable and water-impermeable materials.

As discussed in further detail below, the drive assembly includes a motor 160 which rotates an impeller 120 to create a low pressure area in the interior of the body, and thereby draws water and debris through an inlet 114 provided in the housing cover 108 of the cleaner 100. The housing cover 108 is attached at the front portion of the body 106 by a fastener 124, such as a clip, snap fitting or other well-known fasteners. Preferably, the housing cover 108 and body 106 open proximate the middle of the housing 102 to readily enable access to the interior and cleaning of the filter assembly 118 (FIG. 2).

In a preferred embodiment, the housing cover 108 includes an elongated inlet 114 that extends laterally across the lower front end of the housing cover 108. In an embodiment, one or more rollers or wheels 112 are positioned on either side of the inlet 114 to enable the front portion of the cleaner 100 to be rolled along the surfaces to be cleaned.

In one embodiment, the rollers 112 are removable for purposes of replacement and/or maintenance of the cleaner 100. For example, each roller 112 can be a wheel having an axle 122 extending laterally through the center in a well-known manner. The wheel is removably inserted into a wheel-well 113, which includes opposing channels 115 on each side of the wheel-well 113. The opposing channels 115 of each wheel-well 113 are configured to receive the opposing ends of the axle 122 of a wheel 112. The opposing ends of the axle 122 of each wheel 112 snap-fit in the channel 115 and are thereby rotatable about the axle 122 in a conventional manner. Each wheel 112 can be removed from the cleaner by pulling the wheel away from the cleaner until the opposing ends of the axle 122 pop out from the opposing channels 115 of the wheel-well, thereby freeing the wheel. The wheels are configured and dimensioned to position the inlet at an optimum position during use to maximize the force of the water and debris flowing into the cleaner body and filter.

Figure 2:
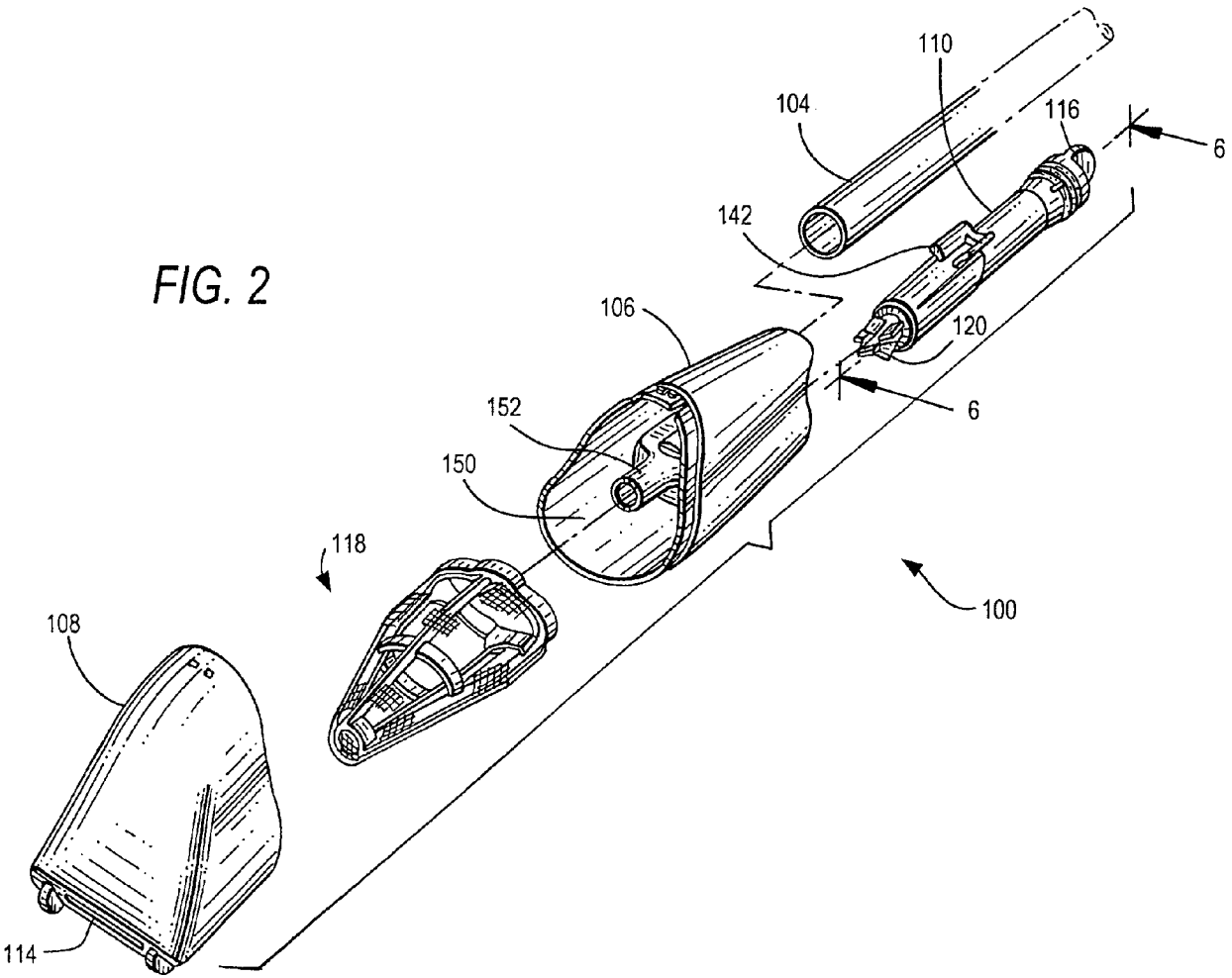
FIG. 2 depicts an exploded front, right side perspective view of the power cleaner of FIG. 1.

Referring to FIG. 2, an exploded front, right side perspective view of the power cleaner 100 is illustratively shown. FIG. 2 illustrates that the body 106 includes an interior portion 150 having an intermediate conduit 152 extending along the longitudinal axis of the body 106. A filter assembly 118 is positioned over the intermediate conduit 152, and the front housing cover 108 is positioned over the filter assembly 118 while secured to the front of the body 106.

Figure 8:
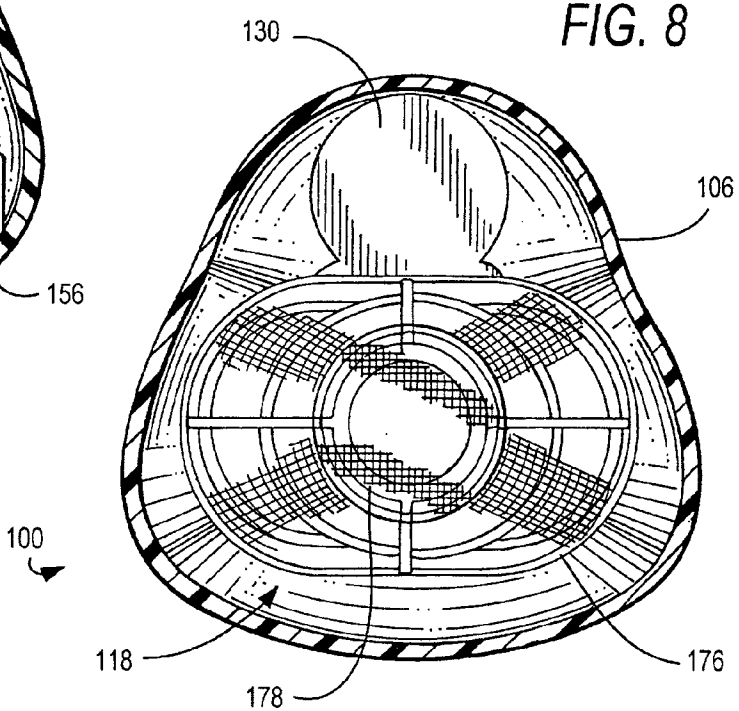
FIG. 8 is a cross-sectional view of the interior side of a housing body of the power cleaner taken along line 8-8 of FIG. 4 and illustrating a filter assembly.

Referring to FIG. 8, a front cross-sectional view of the body 106 is illustratively shown. The filter assembly 118 includes a frame 176 illustratively having a cone-shaped configuration with a plurality of longitudinal ribs spaced apart and extending longitudinally front to back, and a plurality of concentrically spaced ribs positioned perpendicular to the longitudinal rigs and generally spaced from the front end to the rear end to thereby form the frame. A person of ordinary skill in the art will appreciate that the cone shaped frame and arrangement of ribs is not considered limiting. A mesh fabric material 178 is attached over the frame 176 to filter and prevent debris from being drawn through the intermediate conduit 152 and out through the pair of discharge conduits 180. The mesh fabric 178 can be a stainless steel wire mesh, nylon mesh or fabricated from any other mesh-like material suitable for filtering debris and resistant to degradation.

Figure 3:
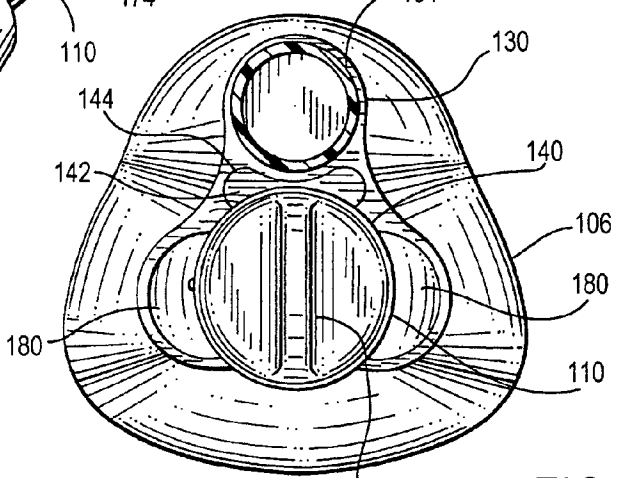
FIG. 3 depicts a rear view of the power cleaner of FIG. 1.
Figure 4:
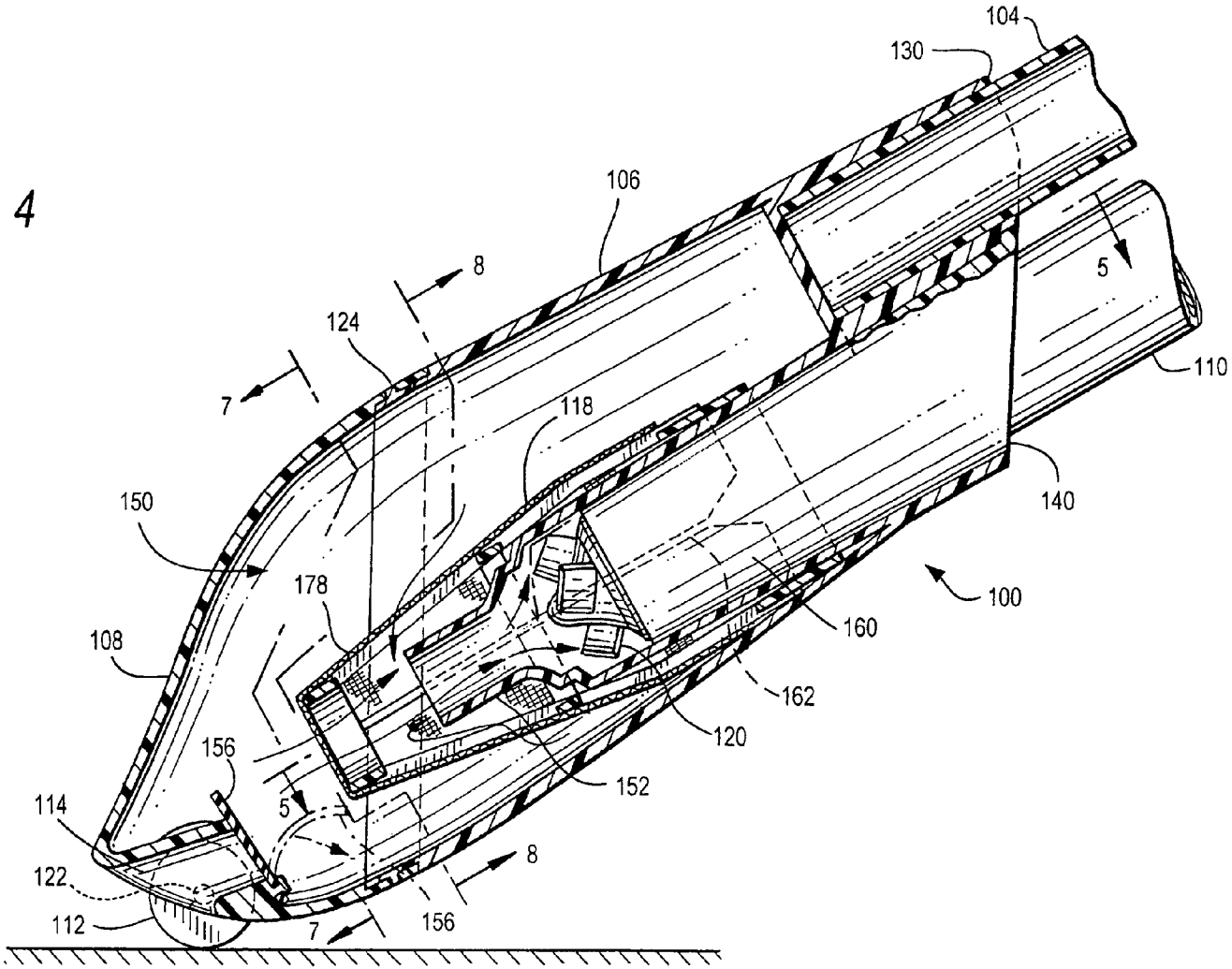
FIG. 4 is a cross-sectional view of the power cleaner taken along lines 4-4 of FIG. 1.

Referring also to FIGS. 3 and 4, the handle 104 is removably inserted into a handle channel 130 which extends longitudinally along the upper rear portion of the body 106. Preferably, the handle 104 is a tubular pole having a lower end that is retained in the channel 130 by opposing frictional forces as between the inner surface of the channel 130 and the outer surface of the handle 104. Alternatively, the lower end of the handle 104 can be inserted and retained in the handle channel 130 by threaded connection, snap fasteners, clips, among other well-known fasteners. In one embodiment, the handle 104 is a plurality of segmented poles that snap-fit together end to end to form an elongated or telescopic pole or handle 104.

The body 106 of the cleaner 100 further includes a second channel 140 positioned below the first handle channel 144. The second channel 140 is configured to receive at least the front end of the drive assembly 110. The drive assembly 110 is preferably removable to enhance ease of service of the cleaner 100, including replacement of and insertion into (i.e., interchangeability with) other cleaner bodies, as required.

In one embodiment, a keyed locking member 142 is formed on the forward outer surface of the drive assembly 110. A third channel 144 is formed in the body 106 between the handle channel 130 and the drive assembly channel 140. The third channel 144 is dimensioned to conform to the keyed locking member 142 of the drive assembly 110. In one embodiment, the third channel 144 and keyed locking member 142 of the drive assembly 110 align and provide additional frictional forces to help retain the drive assembly in the second channel 140. Optionally, a set screw or other fastener can also be provided in the keyed locking member 142 to secure the drive assembly 110 in the third channel 144 and fastened to the body 106 of the cleaner 100. During installation, the front end of the drive assembly 110 is inserted into the drive assembly channel 140 such that the keyed locking member 142 is also aligned and inserted into the third channel 144. The keyed locking member 142 and corresponding third channel 144 help retain the drive assembly 110 in the channel 130, as well as prevent the drive assembly 110 from rotating therein.

Figure 6:
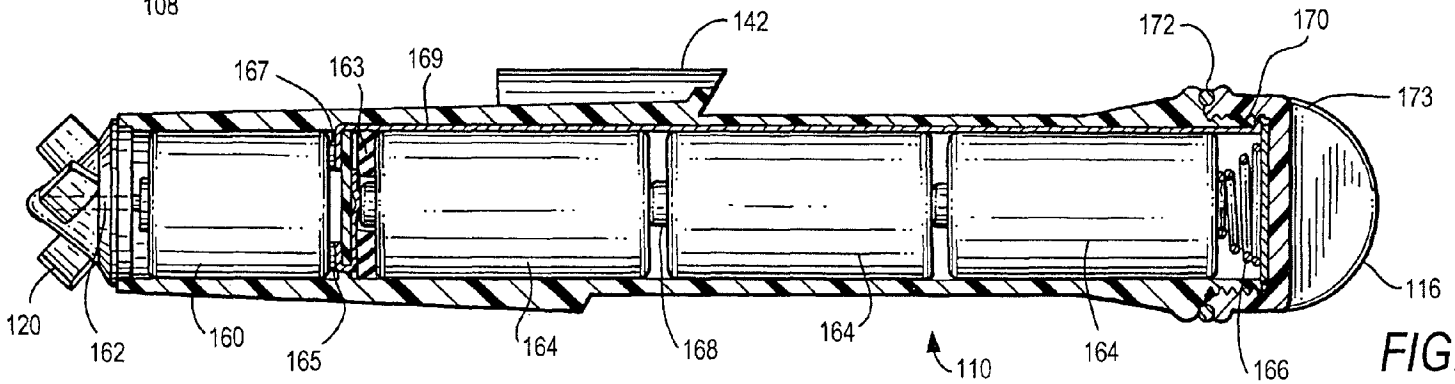
FIG. 6 is a partial cross-sectional view of a drive assembly with an impeller taken along lines 6-6 of FIG. 2.

Referring now to FIG. 6, the drive assembly 110 is an elongated tubular structure that is dimensioned to receive an impeller motor 160 and one or more batteries 164 in a watertight compartment. The impeller motor 160 includes a rotatable impeller shaft 162 that extends longitudinally from its front end and the impeller 120 is attached to the distal end of the shaft 162 in a well-known manner. The opposing rear end of the motor 160 includes a pair of electrical contacts 168 that selectively receive power from the one or more serially arranged batteries 164 when the power switch 116 is activated.

As illustratively shown in FIG. 6, the stator of the motor 160 includes a positive motor terminal 165 and a negative motor terminal 167. Three batteries 164 are serially arranged such that the positive pole of a first battery contacts a first positive electrical lead 168 that is serially connected to the positive terminal 165 of the motor 160. The negative pole of the illustrative serially coupled third battery contacts a coiled spring 166 which is positioned longitudinally along the internal interior surface of the switch 116. A person of ordinary skill in the art will appreciate that the number of batteries 164 used to provide power to the motor 160 are not considered limiting.

An elongated conductor 169 extends from the negative terminal 167 of the motor 160 to a conductive plate 173, which is positioned between the spring 166 and the interior surface of the switch 116. The power switch 116 is rotatively attached to the rear end of the drive assembly 110 by a threaded interface 170.

In one embodiment, a non-conductive washer 163 is positioned adjacently between the first positive contact 168 and the first battery 164. The non-conductive washer 163 is provided to prevent the cleaner from operating in the event the batteries 164 are inserted backwards. Specifically, the centerhole of the washer 163 is dimensioned to allow the longitudinally protruding positive terminal of the first battery 164 to pass through and contact the positive electrical contact 168. If the batteries are reversed, the washer 163 prevents the negative terminal of the battery from contacting the electrical contact 168 coupled to the positive terminal 165 of the motor 160 and thereby precludes activation of the motor in the wrong direction.

When the switch 116 is rotated, e.g., in a counter-clockwise direction, the plate 173 disengages from the end of the conductor 169 thereby forming an open circuit to deactivate the motor 160. Conversely, when the power switch 116 is rotated in the opposite, e.g., clockwise direction, the plate 173 comes into contact with the end of the conductor 169, thereby completing the circuit path and providing power from the batteries 164 to activate the motor 160. Markings 174 can be provided on the outer surface of the switch 174 to identify the "on" and "off" positions.

Preferably, a seal such as an O-ring is provided between the power switch 116 and the rear end of the drive assembly 110 to waterproof and prevent leakage of water into the interior of the drive assembly 110. Similarly, the front end of the drive assembly 110 also includes a seal (not shown) positioned behind the impeller 120 to prevent leakage of water into the interior of the drive assembly 110 and motor/battery compartment.

Preferably, the impeller 120 includes a plurality of blades that produce a flow of water which is angled approximately sixty degrees from the central axis along the impeller shaft 162, as opposed to being angled ninety degrees which is a common for a radial impeller. Angling the impeller approximately sixty degrees increases the flow rate of the fluid through the cleaner 100. In one embodiment, the impeller 120 can include four blades having a pitch in the range of approximately 40 to 120 millimeters, although the number of blades and the pitch are not considered limiting.

Figure 5:
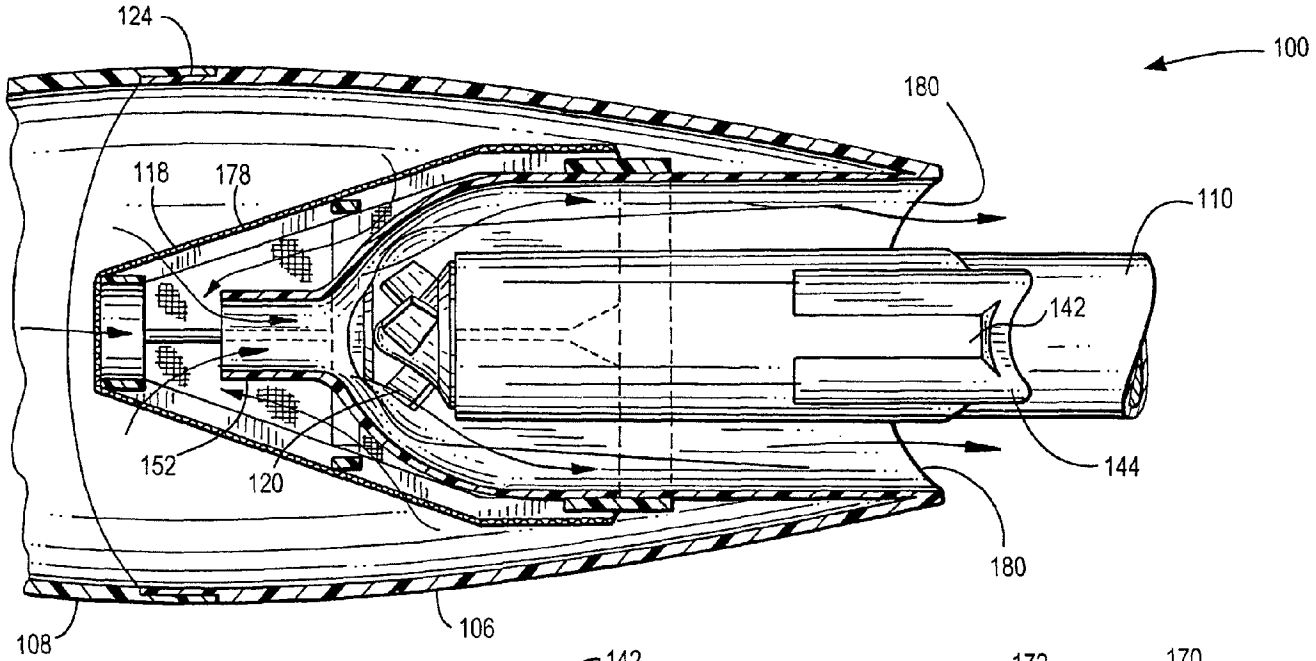
FIG. 5 is a top, partial cross-sectional view of the power cleaner taken along lines 5-5 of FIG. 4.

Referring to FIGS. 4 and 5, the power cleaner 100 is preferably held at an angle with respect to the bottom surface of the pool. The rollers 112 rotate about their respective axles 122 along the pool surfaces while the inlet 114 is directed towards the bottom surface of the pool to draw in the water and debris. Advantageously, the rollers 112 increase the performance of the vacuuming or suction process by maintaining the inlet 114 at an optimal distance from the surface being cleaned. Further, the rollers 112 enhance movement along the surface being cleaned, as well as prevent scratching or damage to the surfaces of the pool, i.e., vinyl fabric pools.

Figure 7:
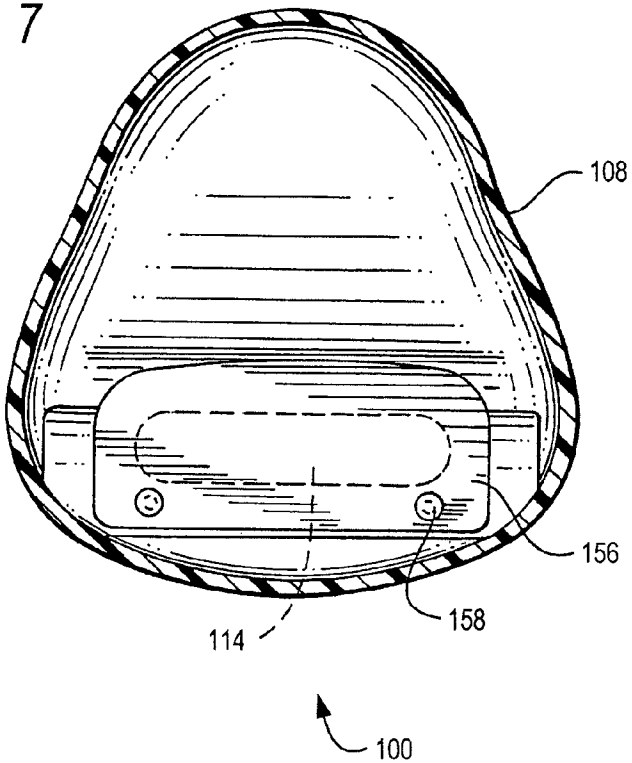
FIG. 7 is a cross-sectional view of the interior side of a forward housing cover of the power cleaner taken along line 7-7 of FIG. 4 and illustrating a flexible inlet flap positioned over an inlet.

Referring to FIG. 7, the inlet 114 includes a flexible resilient flap valve 156 which is attached to the interior of the housing cover 108 by one or more fasteners 158, such as rivets and screws, among other well-known fasteners. As shown in FIGS. 4 and 7, the resilient flap valve 156 is preferably attached at the bottom of the inlet 140, which helps increase suction through the opening. During operation, when the drive assembly 110 is activated and the impeller 120 rotates, the pool water and debris is drawn through the inlet 114, and the flexible flap valve 156 bends in an inwardly and downward direction towards the interior bottom of the cover 108 to allow the pool water/debris to pass through the inlet 114 and into the interior position 150 of the body 106.

In particular, when the impeller 120 is rotating, the water drawn through the inlet 114 passes through the filter assembly 118 and the mesh filter 178 prevents the debris from the pool from flowing through intermediate conduit 152 and out the discharge outlets 180. Further, the captured debris is retained in the interior 150 of the body 106 and housing cover 108, since the flap valve 156 is biased to close the inlet 114 when power to the cleaner is turned off or the unit is removed from the water.

Moreover, the open interior area between the inlet 114 and the filter assembly 118 allows the fluid velocity to diminish such that the heavier debris drops out of suspension, and can be retained along the interior walls of the housing 102; finer debris is captured by the filter. The flow rate (FR) of the fluid (water) is the product of the fluid velocity (v) and flow area (A), where FR=vA). As the flow rate of the fluid is constant, once the fluid flows from the smaller inlet channel 114 into the larger interior area 150, the velocity of the fluid is reduced, thereby allowing the debris to be captured within the interior 150 of the housing 102.

Referring to FIG. 5, the water passing through the filter mesh 178 flows through the intermediate conduit 152 and is directed around the drive assembly 110 through a pair of lateral discharge (i.e., exhaust) conduits 180. Accordingly, the water flowing through the intermediate conduit 152 and discharge through the pair of lateral discharge conduits 180 is generally aligned with the longitudinal axis of the unit and forms a pair of water jets that urge the cleaner 100 in a forward direction along the surface of the pool cleaner. Further, the rearwardly extending discharge conduits 180 direct the expelled water jet away from the pool bottom so as not to disturb the debris on the bottom of the pool before it is drawn into the inlet 114. An advantage of the dual discharge conduits 180 over a single discharge conduit is that the velocity of the exhaust fluids through the dual discharge conduits is less than that through a single discharge conduit having the same area. A reduction in the velocity of the exhaust fluids also reduces the likelihood of stirring up the debris in the pool. The dual discharge conduits 180 also provide a more balanced load on the impeller shaft 162, which helps reduce wear on the seal (not shown) circumscribing the shaft 162.

When the drive assembly 110 is deactivated and the impeller 120 stops rotating, the resilient flap valve 156 returns to its original position against the interior mating surface of the inlet 114 to thereby trap the captured debris inside the interior area 150 of the body 106 and housing cover 108.

Although an exemplary description of the invention has been set forth above to enable those of ordinary skill in the art to make and use the invention, that description should not be construed to limit the invention, and various modifications and variations can be made to the description without departing from the scope of the invention, as will be understood by those with ordinary skill in the art, and the scope thereof is determined by the claims that follow.

We claim:

1. A hand-held submersible power cleaner for cleaning debris from a swimming pool, comprising:

an elongated housing having an inlet positioned at a front end thereof and communicating with an interior cavity formed within the housing;

an intermediate conduit having a front end and an opposing rear end, the front end extending longitudinally through a portion of said interior cavity;

a filter assembly positioned within the cavity between the inlet and front end of the intermediate conduit;

a removable drive assembly having a motor-driven impeller mounted for rotation at a forward end and a power switch at an opposing end, the forward end of the drive assembly being removably insertable into a channel with the impeller facing the rear end of the intermediate conduit;

at least one outlet conduit in communication with the rear end of the intermediate conduit, wherein activation of the impeller draws pool water and debris through the inlet, and the filter assembly filters the debris and retains it in the cavity while the cleansed water flows through the filter assembly, the intermediate conduit and is discharged through the at least one outlet conduit.

2. The hand-held submersible power cleaner of claim 1, further comprising a first channel formed in a rear end of said housing for removably receiving a handle.

3. The hand-held submersible power cleaner of claim 1, wherein the housing comprises an elongated body and a housing cover, the housing cover being removably attached to a front portion of the elongated body and including the inlet.

4. The hand-held submersible power cleaner of claim 3, wherein the interior of the housing and a portion of the interior of the body form the cavity.

5. The hand-held submersible power cleaner of claim 3, further comprising a resilient flap disposed to cover the inlet when the cleaner is not drawing water to prevent the escape of debris from the cavity, and to flex backwards into the cavity to permit flow of water and debris into the filter assembly.

6. The hand-held submersible power cleaner of claim 1, wherein the filter assembly includes a frame having a mesh filter material removably disposed thereon.

7. The hand-held submersible power cleaner of claim 1, further including a second channel formed in the rear end of the housing and configured to removably receive the front end of the drive assembly in close-fitting relation.

8. The hand-held submersible power cleaner of claim 7, wherein in the second channel and front end of the drive assembly are keyed to align and provide frictional forces to securely retain the drive assembly in the second channel.

9. The hand-held submersible power cleaner of claim 1, wherein the drive assembly comprises a motor having a rotating shaft for the impeller, and at least one battery for providing power to the motor.

10. The hand-held submersible power cleaner of claim 9 further comprising a waterproof battery compartment that is axially aligned with the shaft of the motor.

11. The hand-held submersible power cleaner of claim 9, wherein the drive assembly further comprises a power switch for selectively activating the motor.

12. The hand-held submersible power cleaner of claim 9, wherein the power switch is located at the exterior end of the drive assembly opposite the motor.

13. The hand-held submersible power cleaner of claim 9, wherein the impeller includes a plurality of blades that produce a flow of water from the blades which is angled approximately sixty degrees from the central axis along the impeller shaft.

14. The hand-held submersible power cleaner of claim 1, wherein the at least one outlet conduit extends longitudinally along the rear end of the housing.

15. The hand-held submersible power cleaner of claim 14, wherein the at least one outlet conduit comprises a pair of outlet conduits, each outlet conduit being positioned on an opposing lateral side of the drive assembly.

16. The hand-held submersible power cleaner of claim 1, further comprising a pair of rollers rotatably mounted adjacent the inlet at the front end of the housing.

17. The hand-held submersible power cleaner of claim 1, wherein the impeller includes a plurality of blades having a pitch in the range of approximately 40 to 120 millimeters.

* * * * *